US005259131A

United States Patent [19]

Mattesky

[11] Patent Number: 5,259,131

[45] Date of Patent: Nov. 9, 1993

[54] PEARLESCENT IRONING BOARD COVER

[75] Inventor: Henry Mattesky, Cedar Grove, N.J.

[73] Assignee: Herbert Glatt, Morristown, N.J.

[21] Appl. No.: 923,228

[22] Filed: Jul. 31, 1992

[51] Int. Cl.[5] ..... D06F 83/00; B32B 27/04

[52] U.S. Cl. ..... 38/140; 428/99; 428/196; 428/262; 428/282; 427/288

[58] Field of Search ..... 428/99, 196, 262, 282; 427/288; 38/140

[56] References Cited

U.S. PATENT DOCUMENTS 4,623,396 11/1986 Kimura et al. ..... 106/417

*Primary Examiner*—Alexander S. Thomas

*Attorney, Agent, or Firm*—Omri M. Behr; Matthew J. McDonald

[57] ABSTRACT

The disclosure is of an ironing board cover comprising a sheet of unbleached cotton treated with acrylic size to fill the interstices thereof and coated over the acrylic with a pearlescent paint containing titanium dioxide and mica particles. Alternatively, coating may be with pearlescent paint only or such paint alternating with the acrylic resin. Such covers do not show any scorch marks which may arise.

10 Claims, 1 Drawing Sheet

PEARLESCENT IRONING BOARD COVER

FIELD OF THE INVENTION

Non-scorching appearing ironing board cover.

BACKGROUND OF THE INVENTION

The use of unbleached cotton fabric for ironing board covers has two problems associated with it. Unbleached cotton carries natural oils which are rather heat sensitive. Thus, if unbleached cotton is utilized as the visible surface on an ironing board cover, the use of a hot iron tends to deteriorate the oils and cause unsightly and undesirable scorch marks even though the cotton fabric itself is not affected by such scorching. One solution to scorching is to bleach the cotton. This, of course, is a substantial additional cost to the raw material.

The problem of scorching of ironing board covers has been with us for many years with no suitable solution available up to the time of the present invention. British Specification 622,575 dated May 4, 1949 provides one solution to the problem by providing a thick layer of water absorbing padding material within a water-tight bag or skin to keep the padding saturated. Clearly, this is a complex undesirable and unsatisfactory solution to the problem.

U.S. Pat. Nos. 4,507,350, 4,438,169 and 4,562,107 teach providing opaque coatings on fabric but these patents do not provide satisfactory teaching for ironing board covers.

U.S. Pat. Nos. 3,940,355 and 4,027,062 disclose fire resistant coatings for fabrics but these coatings are unsatisfactory for inexpensive ironing board covers.

U.S. Pat. No. 4,623,396 discloses a material which can be used in practicing the present invention however, the patent does not teach an ironing board cover as described and claimed herein.

The sizing of unbleached cotton with acrylic sizes which contain fillers, such as calcium carbonate or titanium dioxide, is very well known indeed. It is the standard operating procedure for inexpensive "canvases" which are made of cotton duck. More expensive canvases are linen but are also similarly treated with an acrylic usually under the trade name of "Gesso".

SUMMARY OF THE INVENTION

There is provided a fabric ironing board cover resistant to the appearance of scorch marks, comprising a substrate of unbleached cotton having an upper and a lower surface, that portion of the said upper surface upon which a hot iron can be set, is coated with at least a sufficient amount of print base coating to fill the interstices of said cotton when dry. Said a print base comprising: acrylic binder resin, defoaming agent, thickening agent, a cross-linking agent and a filler at least one member selected from the group consisting of titanium oxide and calcium carbonate. There is further provided a pearlescent layer atop said base layer of acrylic binder resin, defoaming agent, thickening agent, a cross-linking agent, mica particles between 1 and 400 microns in diameter, and a heat resistant pigment suspension.

If desired, the base layer additionally comprises pigment. Furthermore the pearlescent layer additionally may comprise "Afflair", a proprietary composition comprising mica titanium dioxide and pigment.

Suitably, the pigment is a heat resistant pigment with resistance of at least 200° C., such as copper phthalocyanine, dioxazine, perylene, iron oxide pyranthrone, quinacridone, chrome titanate and nickel titanate.

The method making a fabric ironing board cover resistant to the appearance of scorch marks, comprising a substrate of unbleached cotton having an upper and a lower surface, wherein at least that portion of the said upper surface upon which a hot iron can be set, comprises first coating upon the upper surface thereof of at least a sufficient amount of base coating to fill the interstices of said cotton Then said base coating, after drying, is further coated with a pearlescent coating suspension. Said base coat comprises a suspension of acrylic binder resin, defoaming agent, thickening agent, and any suitable heat resistant filler, that is to say, one having a heat resistance of at least 200° C., for example at least one member selected from the group consisting of titanium oxide and calcium carbonate, talc, mica, alumina, clay and silica, and a cross-linking agent in water. The pearlescent suspension comprises acrylic binder resin, defoaming agent, thickening agent, a cross-linking agent, mica particles between 1 and 400 microns in diameter and a heat resistant pigment suspension, in water.

If desired, said base coat suspension further comprises pigment. Additionally, the pearlescent suspension may comprise "Afflair".

The steps of applying the print base and the pearlescent paint can be performed by conventional techniques of coating or printing onto the fabric with appropriate devices.

It is the surprising and unexpected finding herein that if pearlescent paints, which are well known and readily commercially available, are placed as the particular compositions disclosed herein, on an unbleached cotton substrate previously coated with a print base such as disclosed herein, the aforementioned scorch marks would not show through. However, while the placement of an intermediate print base coating will not stop the scorching of the unbleached fabric, but the scorching will be masked by the coating as well as by the pearlescent layer which remain intact during the ironing procedure.

The advantage of blocking the interstices as aforesaid is that it enables the use of lighter weave materials than was possible heretofore.

BRIEF DESCRIPTION OF THE DRAWINGS

The FIGURE shows a plan view of an ironing board cover comprising having a scorch-concealing coating in accordance with the present invention.

DETAILED DESCRIPTION OF THE DRAWINGS

Figure 1:
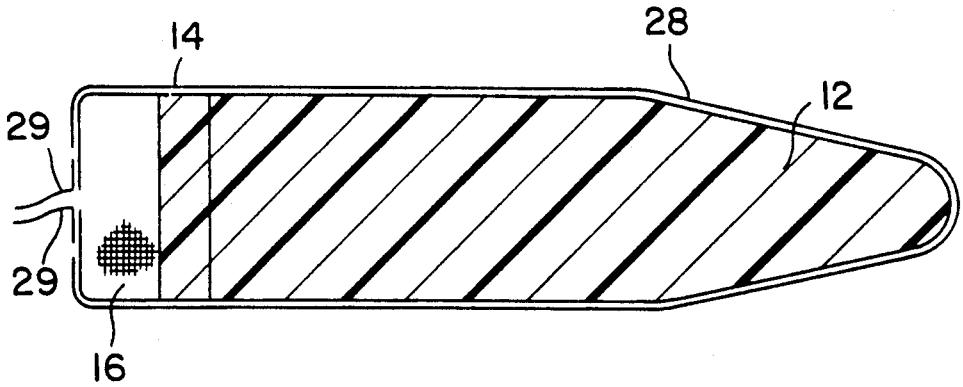

The drawing shows a conventional ironing board cover 12 having a draw string channel 28 containing draw string 29 for affixing said cover on top of an ironing board. Segment 14 is a portion of fabric 12 of the ironing board cover having been coated with both the print base and the pearlescent coating of the present invention. Area 16 is coated with the print base only.

DESCRIPTION OF THE PREFERRED EMBODIMENTS

There is provided a fabric ironing board cover resistant to the appearance of scorch marks, comprising a substrate of unbleached cotton having an upper and a lower surface. The portion of the upper surface upon which a hot iron can be set, is coated with at least a sufficient amount of coating to fill the interstices of said cotton.

In the preferred embodiments of this invention print base which fills the interstices of said cotton comprises: when dry, acrylic binder resin: 30–50% by weight, defoaming agent: 0.1–0.5% by weight, thickening agent: 2–10% by weight, a cross-linking agent: 1–3% by weight, and at least one member selected from the group consisting of titanium oxide and calcium carbonate, talc, mica, alumina, clay and silica: 30–60% by weight of the base. The pearlescent layer atop said base layer, comprises, when dry, acrylic binder resin: 15–30% by weight, defoaming agent: 0.2–0.6% by weight, thickening agent: 5–15% by weight, a cross-linking agent: 0.5–2% by weight, mica particles between 1 and 400 microns in diameter: 20–75% by weight, and a heat resistant pigment suspension: 0–2% by weight of said layer.

In an alternate embodiment the dry print base additionally comprises an amount of pigment of between 0.1 and 0.5% by weight of said base. Furthermore pearlescent layer may additionally comprise "Afflair" of between 5 and 25% by dry weight of said layer.

Suitably, the pigment is a heat resistant pigment with resistance of at least 200° C., such as copper phthalocyanine, dioxazine, perylene, iron oxide pyranthrone, quinacridone, chrome titanate and nickel titanate.

The preferred method of making a fabric ironing board cover resistant to the appearance of scorch marks, with a substrate of unbleached cotton having an upper and a lower surface, comprises coating on that portion of the said upper surface upon which a hot iron can be set, at least a sufficient amount of print base coating to fill the interstices of said cotton, and, when dry further coating said print base with a pearlescent layer coating. If desired, a second base layer may be applied on top of the first, before application of the pearlescent layer.

Said print base coating comprises a suspension of: acrylic binder resin 10–40 dry parts by weight, defoaming agent: 0.01–0.5 dry parts by weight, thickening agent: 1–5 dry parts by weight, at least one member selected from the group consisting of titanium oxide and calcium carbonate: 15–30 dry parts by weight, and a cross-linking agent constituting 0.1–2 dry parts by weight of said base, in a total of water: 100–200 parts by weight relative to total dry weight of said base.

Said pearlescent layer coating comprises a suspension of acrylic binder resin: 1–6 dry parts by weight, defoaming agent: 0.05–0.5 dry parts by weight, thickening agent: 0.5–5 dry parts by weight, a cross-linking agent: 0.05–0.25 dry parts by weight, mica particles between 1 and 400 microns in diameter: 5–15 parts by weight, and a heat resistant pigment suspension: 0–1 parts by weight, in a total of water: 50–200 parts by weight relative to total dry weight of said pearlescent suspension.

Suitably, said print base coat suspension further comprises an amount of pigment of between 0.005 and 1 dry parts by weight of said base. Furthermore, the pearlescent layer coat suspension may additionally comprise "Afflair" of between 0.5 and 5 parts dry weight.

The cotton sheeting is coated with a layer of print base suspension, suitably at a rate of from about 15 to about 30, suitably 22 g of dry coating of said base per $yd^2$ of sheeting. The coating is dried in a 300° F. convection oven for about three minutes. A second similar coating of print base suspension may be applied at a rate of 5–15 g dry coating weight per $yd^2$ of sheeting. Thereafter the pearlescent layer coating suspension is applied at a dry rate of about 6 g/$yd^2$ of bleached cotton. The pearlescent coating is applied in any suitable manner, for example by means of a silk screen or a knife. The coating is dried in a 300° F. convection oven for about three minutes.

The pearlescent appearance of the coating can be enhanced by increasing coating weight, increasing the amount of mica in the top coat formulation, or by smoothing the surface of the print base coated sheeting through calandering.

A preferred coating material includes: a pearlescent paint material, comprising mica and titanium dioxide, such as sold under the Trade Mark Afflair, by EM Industries, Hawthorn, N.Y. containing a coloring agent, a cross linking agent, such as Astro Mel NW-6A and a print base.

The blocking of scorch marks in the coated ironing board cover of the invention is achieved by light interference in the pearlescent layer. The pearlescent layer includes titanium dioxide and mica particles and A light ray striking the pearlescent coating can follow several paths. Some light passing through a medium of low index of refraction is reflected upon reaching the titanium dioxide surface. This occurs because of the high index of refraction of titanium dioxide and the refractive index discontinuity at the medium titanium dioxide interface. A portion of the remaining light passes into the titanium dioxide layer and is reflected again at the refractive index discontinuity existing at the titanium dioxide mica interface.

EXAMPLES

General Coating Method

The base coat is applied to unbleached cotton sheeting (48 g/$yd^2$) with a knife at a rate of 18 g/$yd^2$. The sheeting was dried in an convection oven at 300° F. After drying pearlescent (top) coating of one of the formulations set forth below was applied by silk screening, at the same dosage level, the desired pattern on the base coat surface and similarly dried.

The aforesaid coated sheetings are then manufactured into ironing board covers by methods well known in the art.

PEARLESCENT FORMULATIONS

| | Description: Blue | | | | | |
|---|---|---|---|---|---|---|
| Material | Wet Weight BASE | (parts) TOP | Dry Weight BASE | (parts) TOP | Dry Weight BASE | % TOP |
| Water | 160 | 100 | 0 | 0 | 0 | 0 |
| Defoamer NS103 | 0.2 | 0.1 | 0.2 | 0.1 | 0.32 | 0.57 |
| Methocel K4MS | 4.2 | 2.0 | 4.2 | 2.0 | 6.72 | 11.4 |
| Teflon emulsion | — | 0.5 | — | 0.35 | 0 | 2.0 |
| Astromel NW-6A | 1.0 | 0.2 | 0.8 | 0.16 | 1.28 | 0.91 |
| Acrylic Resin emulsion | 60.0 | 10.0 | 27.0 | 4.5 | 43.21 | 25.64 |
| Titanium Dioxide emulsion (50% solids) | 30.0 | — | 15.0 | — | 24.01 | 0 |
| Calcium Carbonate | 15.0 | — | 15.0 | — | 24.01 | 0 |
| Afflair 100 | — | 2.5 | — | 2.5 | 0 | 14.25 |
| Mica 221 | — | 7.5 | — | 7.5 | 0 | 42.74 |
| Blue 2G (Inmont) | 1.0 | 1.0 | 0.2 | 0.2 | 0.32 | 1.14 |
| Pink 3BN (OR- | 0.4 | 1.2 | 0.08 | 0.24 | 0.13 | 0.74 |

-continued

| Material | Wet Weight BASE | (parts) TOP | Dry Weight BASE | (parts) TOP | Dry Weight BASE | % TOP |
|---|---|---|---|---|---|---|
| | Description: Blue | | | | | |
| A-SPERSE) | 271.8 | 125.0 | 62.48 | 17.55 | 100 | 99.39 |

| Material | Wet Weight BASE | (parts) TOP | Dry Weight BASE | (Parts) TOP | Dry Weight BASE | % TOP |
|---|---|---|---|---|---|---|
| | Description: Rose | | | | | |
| Water | 160 | 100 | 0 | 0 | 0 | 0 |
| Defoamer NS103 | 0.2 | 0.1 | 0.2 | 0.1 | 0.31 | 0.57 |
| Methocel K4MS | 4.2 | 2.0 | 4.2 | 2.0 | 6.50 | 11.42 |
| Teflon emulsion | — | 0.5 | — | 0.35 | 0 | 2.0 |
| Astromel NW-6A | 1.0 | 0.2 | 0.8 | 0.16 | 1.26 | 0.91 |
| Acrylic resin emulsion | 60.0 | 10.0 | 27.0 | 4.5 | 42.32 | 25.70 |
| Titanium dioxide emulsion (50% solids) | 30.0 | — | 15.0 | — | 23.51 | 0 |
| Calcium Carbonate | 15.0 | — | 15.0 | — | 23.51 | 0 |
| Afflair 100 | — | 2.5 | — | 2.5 | 0 | 14.28 |
| Mica 221 | — | 7.5 | — | 7.5 | 0 | 42.84 |
| Pink 3BN (Inmont) | 8.0 | 2.0 | 1.6 | 0.4 | 2.51 | 2.28 |
| | 278.5 | 124.3 | 63.8 | 17.51 | 100.00 | 100.00 |

| Material | Wet Weight BASE | (parts) TOP | Dry Weight BASE | (Parts) TOP | Dry Weight BASE | % TOP |
|---|---|---|---|---|---|---|
| | Description: Green | | | | | |
| Water | 160 | 100 | 0 | 0 | 0 | 0 |
| Defoamer NS103 | 0.2 | 0.1 | 0.2 | 0.1 | 0.32 | 0.57 |
| Methocel K4MS | 4.2 | 2.0 | 4.2 | 2.0 | 6.66 | 11.3 |
| Teflon emulsion | — | 0.5 | — | 0.35 | 0 | 2.0 |
| Astromel NW-6A | 1.0 | 0.2 | 0.8 | 0.16 | 1.28 | 0.91 |
| Acrylic resin emulsion | 60.0 | 10.0 | 27.0 | 4.5 | 42.80 | 25.51 |
| Titanium Dioxide emulsion (50% solids) | 30.0 | — | 15.0 | — | 23.78 | 0 |
| Calcium Carbonate | 15.0 | — | 15.0 | — | 23.78 | 0 |
| Afflair 100 | — | 2.5 | — | 2.5 | 0 | 14.18 |
| Mica 221 | — | 7.5 | — | 7.5 | 0 | 42.34 |
| Luconyl Green 872 | 2.2 | 1.0 | 0.88 | 0.4 | 1.40 | 2.27 |
| | 272.7 | 123.9 | 63.08 | 17.63 | 100.00 | 100.00 |

I claim:

1. A fabric ironing board cover resistant to the appearance of scorch marks, comprising a substrate of unbleached cotton having an upper and a lower surface, that portion of the said upper surface upon which a hot iron can be set, being coated with at least a sufficient amount of:

a) print base to fill the interstices of said cotton therewith comprising when dry, acrylic binder resin: 30–50% by weight,
defoaming agent: 0.1–0.5% by weight,
thickening agent: 2–10% by weight,
a cross-linking agent: 1–3% by weight,
a heat resistant filler, resistant to at least 200° C.: 30–60% by weight of the base, and b) a pearlescent layer atop said base layer comprising, when dry:

acrylic binder resin: 15–30% by weight,
defoaming agent: 0.2–0.6% by weight,
thickening agent: 5–15% by weight,
a cross-linking agent: 0.5–2% by weight,
mica particles between 1 and 400 microns in diameter: 20–75% by weight, and a heat resistant pigment suspension: 0–2% by weight of said layer.

2. A cover of claim 1 wherein the filler is at least one member selected from the group consisting of titanium oxide, calcium carbonate, talc, mica, alumina, clay and silica.

3. A cover of claim 1, wherein said print base, when dry, additionally comprises an amount of pigment of between 0.1 and 0.5% by weight of said base.

4. A cover of claim 1 wherein said pearlescent layer, when dry, additionally comprises "Afflair" pigment of between 5 and 25% by dry weight of said layer.

5. A cover of claim 1 wherein the pigment is selected from the group consisting of copper phthalocyanine, dioxazine, perylene, iron oxide pyranthrone, quinacridone, chrome titanate and nickel titanate.

6. A method of making a fabric ironing board cover resistant to the appearance of scorch marks, comprising a substrate of unbleached cotton having an upper and a lower surface, coating that portion of the said upper surface upon which a hot iron can be set, with at least a sufficient amount of print base coating suspension to fill the interstices of said cotton, and, when dry further coating said print base with a pearlescent layer coating suspension, said print base coating suspension comprising:

acrylic binder resin: 10–40 dry parts by weight,
defoaming agent: 0.01–0.5 dry parts by weight,
thickening agent: 1–5 dry parts by weight,
a heat resistant filler, resistant to at least 200° C.: 15–30 dry parts by weight, and
a cross-linking agent: 0.1–2 dry parts by weight of said base,
in water to a total of 100–200 parts by weight relative to total dry weight of said base, said pearlescent layer coating comprises a suspension of:

acrylic binder resin: 1–6 dry parts by weight,
defoaming agent: 0.05–0.5 dry parts by weight,
thickening agent: 0.5–5 dry parts by weight,
a cross-linking agent: 0.05–0.25 dry parts by weight,
mica particles between 1 and 400 microns in diameter: 5–18 parts by weight, and
a heat resistant pigment suspension constituting 0–1 parts by weight,
in water to a total of 50–200 parts by weight relative to total dry weight of said pearlescent coating suspension.

7. The method of claim 6 wherein the filler is at least one member selected from the group consisting of titanium oxide, calcium carbonate, talc, mica, alumina, clay and silica.

8. The method of claim 6 wherein said print base coat suspension further comprises an amount of pigment of between 0.005 and 1 dry parts by weight of said base.

9. The method of claim 6 wherein the pearlescent layer coat suspension additionally comprises "Afflair" pigment of between 0.5 and 5 parts dry weight.

10. The method of claim 6 wherein the pigment is selected from the group consisting of copper phthalocyanine, dioxazine, perylene, iron oxide, quinacridone, pyranthrone, chrome titanate and nickel titanate.

* * * * *